United States Patent [19]

Whitehead

[11] 4,327,896

[45] May 4, 1982

[54] COLLAPSIBLE JACK

[76] Inventor: Rickey E. Whitehead, Rte. 1, Fairview, Mo. 64842

[21] Appl. No.: 205,947

[22] Filed: Nov. 12, 1980

[51] Int. Cl.[3] ..... E02C 3/00

[52] U.S. Cl. ..... 254/88

[58] Field of Search ..... 254/88, 2 B

[56] References Cited

U.S. PATENT DOCUMENTS

| | | | |
|---|---|---|---|
| 1,791,986 | 2/1931 | Vehm | 254/88 |
| 1,855,949 | 4/1932 | Dubroca | 254/88 |
| 1,871,129 | 8/1932 | Pierce | 154/88 |
| 1,904,693 | 4/1933 | Meyers et al. | 254/88 |
| 2,076,069 | 4/1937 | Davis | 254/88 |
| 3,178,156 | 4/1965 | Rigers | 254/88 |
| 3,302,927 | 2/1967 | Gray | 254/2 B |
| 3,386,703 | 6/1968 | Thumma | 254/88 |
| 3,638,910 | 2/1972 | Nellis et al. | 254/88 |
| 3,994,474 | 11/1976 | Finkbeiner | 254/88 |

FOREIGN PATENT DOCUMENTS

| | | | |
|---|---|---|---|
| 162885 | 5/1955 | Australia | 254/88 |
| 631786 | 9/1929 | France | 254/88 |
| 713858 | 8/1931 | France | 254/88 |
| 994228 | 8/1951 | France | 254/88 |
| 4197807 | 7/1978 | Fed. Rep. of Germany | 254/88 |

*Primary Examiner*—Robert C. Watson

*Attorney, Agent, or Firm*—Roylance, Abrams, Berdo & Farley

[57] ABSTRACT

A collapsible jack comprising a base member, a support member and a ramp member with each member including a plate with side rails coupled to and extending from the plate. Front and rear pivoting mechanisms couple the base, ramp and support members each including upper and lower pivot rods extending perpendicular to the side rails and interconnected by rigid braces. The lower pivot rods have opposite ends journaled in the base side rails, while the opposite ends of the upper pivot rods are journaled in the support side rails. The upper ends of the ramp side rails are journaled to the front upper pivot rod. Openings in the ramp and base members are aligned when the jack is in its upright position to receive a locking bar which locks the jack in the upright position.

11 Claims, 5 Drawing Figures

COLLAPSIBLE JACK

BACKGROUND OF THE INVENTION

1. Field Of The Invention

This invention relates to a jack which is movable between upright and collapsed positions. More particularly, the present invention relates to a collapsible jack having pivoting mechanisms pivotally coupled to the base and support members, a ramp member journaled at its upper end to one of the pivoting mechanisms and a locking bar removably received in aligned openings in the ramp and base members to secure the jack in its upright position.

2. Description Of The Prior Art

Conventional ramp-type jacks and stands are often collapsible to permit movement between upright and collapsed positions. In the collapsed position, the devices take up less space to permit efficient storage. Typical examples of these devices are U.S. Pat. Nos. 1,904,693, Myers et al; 1,817,129, Pierce; 3,178,156, Rigers; 3,386,703, Thumma; and 3,638,910, Nellis et al. However, these devices are difficult and slow to move between their collapsed and upright positions, are difficult to manufacture and are not sturdy in the upright position.

SUMMARY OF THE INVENTION

Accordingly, it is an object of the present invention to provide a collapsible jack which can be quickly and simply moved between its upright and collapsed positions and will be sturdy in its upright position.

Another object of the present invention is to provide a collapsible jack which is of rugged construction and which is simple and inexpensive to manufacture and operate.

A further object of the present invention is to provide a collapsible jack which takes up a minimum of space in its collapsed position and has a relatively high strength to weight ratio.

The foregoing objects are obtained by a collapsible jack which is movable between upright and collapsed positions. The jack includes a base member, a support member, a ramp member and a locking bar. The base member includes a base plate and side rails coupled to and extending upwardly from the base plate. Openings are provided in the base side rails adjacent their front ends and aligned along an axis perpendicular to the base side rails. The support member includes a support plate and side rails coupled to and depending downwardly from the support plate. Front and back pivoting mechanisms couple the base plate and support member. Each pivoting mechanism includes upper and lower pivot rods extending perpendicular to the side rails and interconnected by a rigid brace arrangement fixedly coupled to the pivot rods. The lower pivot rods have opposite ends journaled in the base side rails, while the upper pivot rods have opposite ends journaled in the support side rails. The ramp member includes a ramp plate and side rails coupled to and depending downwardly from the ramp plate. Upper ends of the ramp side rails are journaled to the front upper pivot rod, while the lower ends have openings aligned along an axis perpendicular to the ramp side rails. The ramp rail openings are aligned with the base rail openings in the upright position of the jack. A locking bar is removably received in the ramp and base rail openings to lock the jack in its upright position.

By forming the collapsible jack of the present invention in this manner, the parts of the jack are formed into a unit, with the sole exception of the locking bar. The jack may be simply and quickly moved from its collapsed position to its upright position by moving the pivoting mechanisms into a vertical orientation perpendicular to the base and support members. This movement of the pivoting mechanism also moves the ramp in a position such that the openings in the ramp and base members are aligned to receive the locking bar. The mechanisms coupling the support and base members are securely attached by the pivoting mechanisms being journaled to each of the base member and the support member. This attachment of the pivoting mechanisms makes the jack of the present invention extremely sturdy in its upright position. Additionally, this arrangement of the jack makes it is simple and inexpensive to manufacture.

The side rails can be formed from rectangular cross-sectional tubes to facilitate manufacture. To enhance the ground and vehicle wheel gripping surfaces, friction enhancing projections can be provided on the upper surfaces of the support and ramp plates and lower surfaces of the base plate. Additional openings can be provided in the ramp side rails which align with the base rail openings in the collapsed position of the jack to receive the locking bar and lock the jack in its collapsed position to prevent inadvertent opening. To prevent loss of the locking bar, it can be tethered to the base member.

The base rails can be spaced apart by a greater distance than the support side rails to permit the support rails to nest between the base side rails in the collapsed position. This enables the jack to take up less space in its collapsed position. The use of blind bores in the base and support side rails protects the connection between the pivoting mechanisms and the base and support members. The blind bores extend only through the inner walls of the side rails, and not entirely through the side rails. With the support side rails spaced apart a distance less than the ramp side rails, a smaller collapsed position is provided. The base plate may extend forwardly beyond the base openings to form a traction pad in front of the ramp member in its upright position. The provision of such traction pad facilitates the driving of a vehicle onto the jack.

The brace arrangement of the pivoting mechanisms may comprise two bars oriented at an acute angle and fixedly coupled at their opposite ends to respective pivot rods. This provides a secure and simple connection between the pivot rods to maximize the loading capacity of the jack.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this original disclosure.

DETAILED DESCRIPTION OF THE PREFERRED EMBODIMENT OF THE INVENTION

Figure 1:
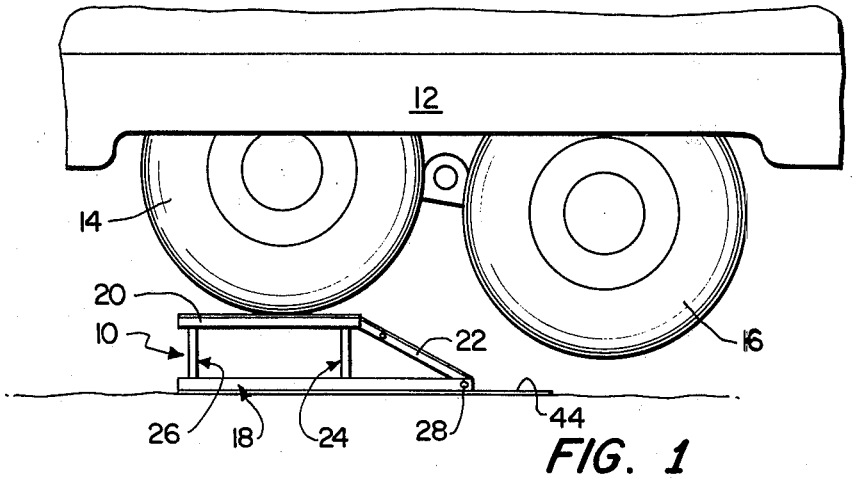
FIG. 1 is a side elevational view of a jack in accordance with the present invention illustrating use with a vehicle having tandemly mounted wheels.

Referring to FIG. 1, the jack 10 is illustrated in use with a vehicle 12 having tandemly mounted wheels 14, 16. Jack 10 comprises a base member 18, a support member 20 and a ramp member 22. Members 18, 20, 22 are coupled by pivoting mechanisms 24, 26 and are locked in the upright position illustrated in FIG. 1 by a removable locking pin 28.

In use, vehicle 12 is driven up ramp member 22 to position wheel 12 on support member 20. In this position, the other wheel 16 of the tandem arrangement will be positioned above the ground to permit it to be removed from the vehicle or otherwise serviced.

Figure 4:
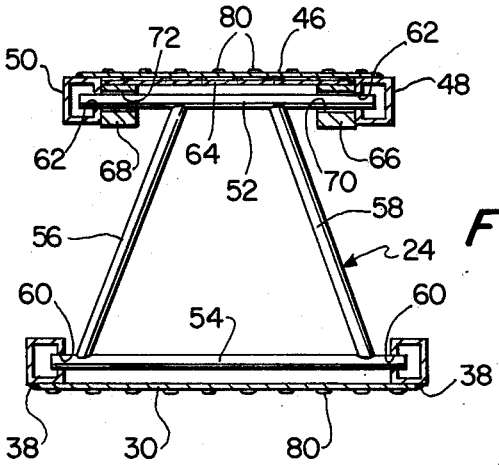
FIG. 4 is a front elevational view in cross-section of the jack taken along lines 4—4 of FIG. 2.
Figure 2:
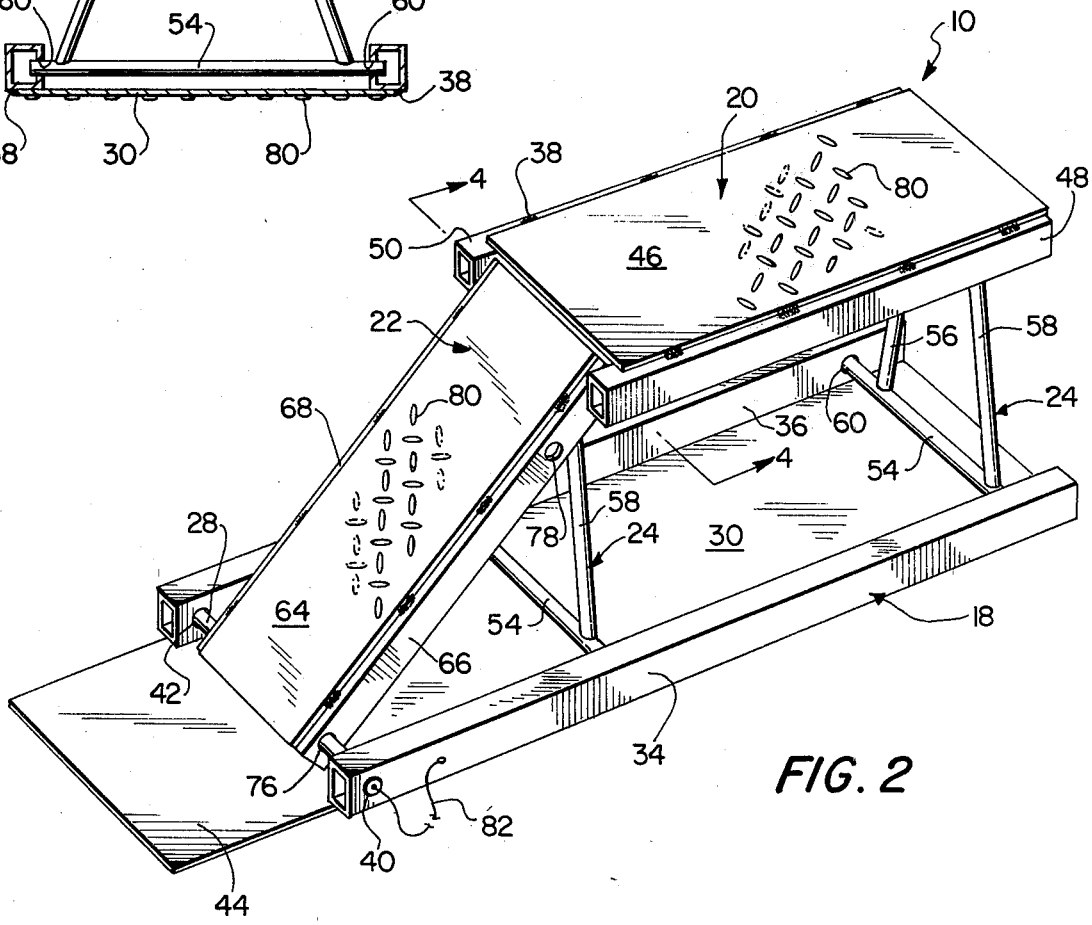
FIG. 2 is an enlarged perspective view of the jack of FIG. 1 in its upright position.
Figure 3:
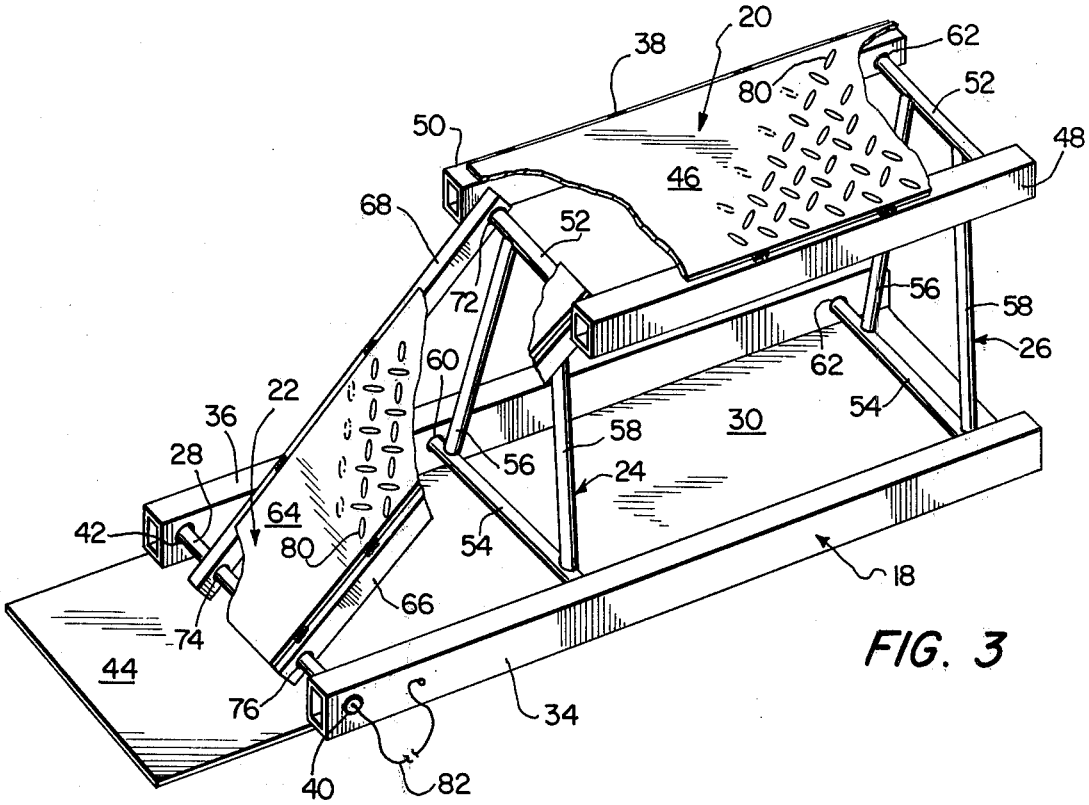
FIG. 3 is a perspective view of the jack as shown in FIG. 2 with parts cut away.

The details of jack 10 are illustrated in FIGS. 2–4. Base member 18 comprises a rectangular base plate 30 formed of hot rolled steel (typically 14 gauge) and parallel side rails 34, 36 formed from rectangular tubing (typically 16 gauge, one inch×one-half inch). Side rails 34, 36 are secured along the opposite side edges of base plate 30 by spot welds 38. To facilitate welding, side rails 34, 36 straddle the side edges of plate 30. Openings 40, 42 are formed in the front ends of side rails 34, 36, respectively, and are aligned along an axis extending perpendicular to side rails 34, 36. These openings extend entirely through the side rails. Base plate 30 is longer than side rails 34, 36 so that base plate 30 extends forwardly beyond openings 40, 42 to form a traction pad 44 in front of ramp member 22 while jack 10 is in its upright position.

Support member 20 comprises a rectangular support plate 46 and parallel side rails 48, 50. The plate and side rails of support member 20 are formed of the same materials as and are secured in a similar manner as the plate and side rails of base member 18 by spot welds 38. Side rails 48, 50 are longer than support plate 46 and extend forwardly from the forward edge of base plate 46. Base side rails 34, 36 are spaced apart by a distance which is greater than the distance between support side rails 48, 50. This spacing differential permits the support side rails to nest between the base side rails in the collapsed position of jack 10.

Base member 18 and support member 20 are movably coupled by front and rear pivoting mechanisms 24, 26 which are substantially identical in form. Each pivoting mechanism, as illustrated in FIG. 4, comprises an upper pivot rod 52, a lower pivot rod 54 and two brace bars 56, 58. Brace bars 56, 58 are rigid, oriented at acute angles to each other, and fixedly coupled to their opposite ends to upper and lower pivot rods 52, 54, for example by welding.

Upper and lower pivot rods 52, 54 are parallel and extend perpendicular to the side rails of the base and support members 18, 20. Lower support rods 54 have their opposite ends journaled in blind bores 60 in side rails 34, 36. The opposite ends of the upper pivot rods 52 are journaled in blind bores 62 in support side rails 48, 50.

Ramp member 22 includes a ramp plate 64 and parallel ramp side rails 66, 68. The materials and attachment of the plate and side rails of ramp member 22 is similar to those of support member 20 and base member 18.

Figure 5:
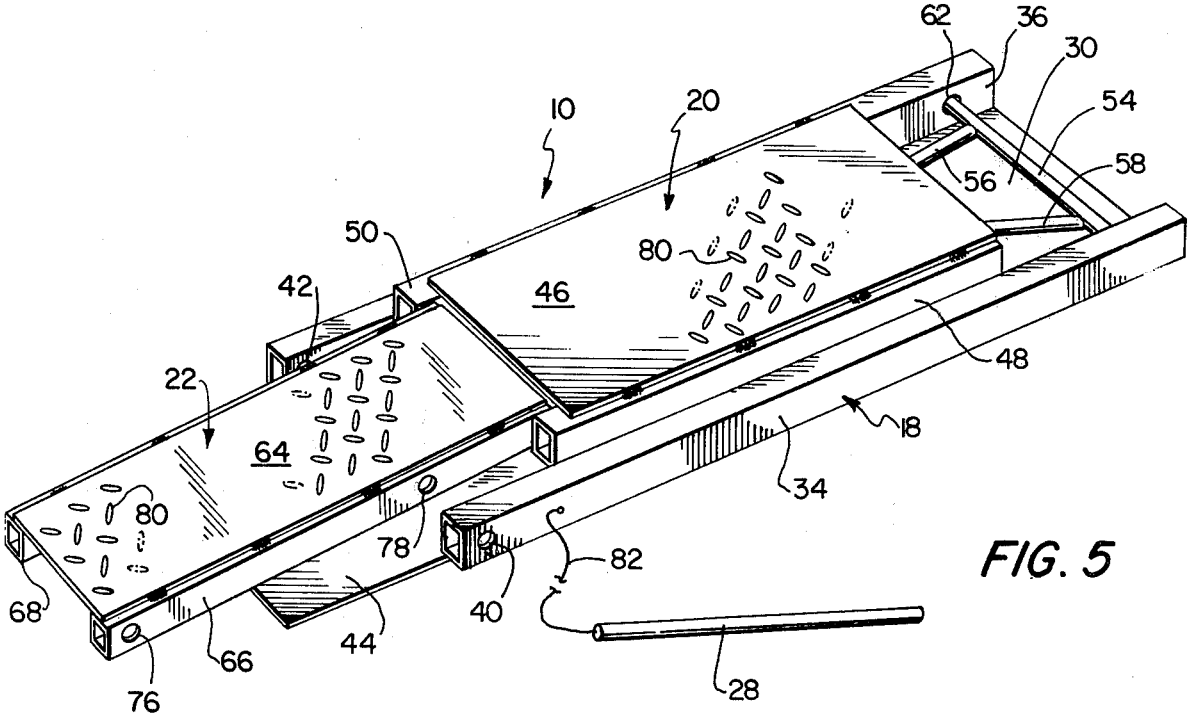
FIG. 5 is a perspective view of the jack of FIG. 2 in its collapsed position.

Side rails 66, 68 depend from the side edges of ramp plate 64. The upper ends of ramp side rails 66, 68 have openings 70, 72 aligned along an axis perpendicular to ramp side rails 66, 68 to journal the upper ends of the ramp side rails to upper pivot rod 52 of front pivoting mechanism 24. The lower ends of ramp side rails 66, 68 having openings 74, 76 aligned along an axis perpendicular to the ramp side rails. Openings 74, 76 are aligned with openings 40, 42 in the front ends of base side rails 34, 36 when ramp member 22 is oriented in the upright position of jack 10 illustrated in FIGS. 2 and 3. Additional openings 78 are formed in ramp side rails 66, 68 between their opposite ends. These additional openings are aligned along an axis perpendicular to the ramp side rails and may be aligned with base openings 40, 42 in the collapsed position of jack 10 as illustrated in FIG. 5.

Support side rails 48, 50 are spaced apart by a distance less than the distance between ramp side rails 66, 68. This permits side rails 66, 68 to be journaled on pivot rod 52 inside of blind bores 62 and support side rails 48, 50, and exterior of brace bars 56, 58.

The upper surfaces of support plate 46 and ramp plate 64 and the lower surface of base plate 30 are provided with a pattern of friction enhancing oblong projections 80. The projections on the support and ramp plates enhance the traction of the vehicle wheels in moving onto, off of and remaining on jack 10. The projections on the lower surface of base plate 30 enhance the frictional engagement between jack 10 and the ground to restrain movement of jack 10 during loading and unloading of vehicle 12.

Locking bar 28 is tethered to base side rail 34 by a light chain 82. Light chain 82 has one end fixedly attached to one end of locking bar 28, while its other end is fixedly attached to base side rail 34.

The separate tubular side rails which are attached to plates to form the side rails of the base, support and ramp members can be replaced by side rails which are formed by folding or rolling over the lateral edges of the plates. Additionally, a suitable bracket may be provided on the back ends of base side rails 34, 36. Such brackets can be located behind rear pivoting mechanism 26 and would contact brace bars 56, 58 when rear pivoting mechanism 26 is pivoted to a position perpendicular to base and support members 18, 20. This contact would prevent rear pivoting mechanism 26 from moving past the perpendicular position.

Jack 10 is locked in the upright position illustrated in FIGS. 1–4 by passing locking bar 28 through the aligned openings 40, 42 in base side rails 34, 36 and through openings 74, 76 in the lower end of ramp member 22. This will prevent the pivoting mechanisms 24, 26 from moving away from an orientation perpendicular to members 18, 20.

To conserve space, jack 10 is moved to the collapsed position illustrated in FIG. 5 when not in use. From the upright position illustrated in FIGS. 2 and 3, locking bar 28 is removed from openings 40, 42 in base side rails 34, 36 and from openings 74, 76 in ramp side rails 66, 68, and is placed along side of base member 18 out of the way. Thereafter, support member 20 is moved forwardly and downwardly as pivoting mechanisms 24, 26 pivot forwardly and downwardly about lower pivot rods 54 and as ramp member 22 pivots upwardly relative to support member 20 about upper pivot rod 52 of forward pivoting mechanism 24. Support member 20 is lowered until the lower surfaces of support side rails 48, 50 contact lower pivot rod 54 of forward pivoting mechanism 24 and are nested between base side rails 34, 36. Ramp member 22 is pivoted relative to support member 20 until members 20, 22 are substantially coplanar and ramp member 22 is substantially parallel to and lies upon base plate 30. In this collapsed position illustrated in FIG. 5, locking bar 28 may be inserted through the now aligned openings 40, 42 in base side rails 34, 36 and openings 78 in ramp side rails 66, 68 to lock jack 10 in its collapsed position and to store locking bar 28.

Jack 10 is reset in its upright position by removing locking bar 28 from openings 40, 42, 78 in the base and ramp side rails. Thereafter, support member 20 is moved rearwardly and upwardly as pivoting mechanisms 24, 26 rotate rearwardly and upwardly about lower pivot rods 54 to positions perpendicular to base and support members 18, 20 and as ramp member 22 pivots about upper pivot rod 52 of forward pivoting mechanism 24 relative to support member 20. Once openings 40, 42 in base member 18 and openings 74, 76 in ramp member 22 are realigned, locking pin 28 is inserted therein to lock jack 10 in its upright position.

Since the pivoting mechanisms 24, 26 are pivotally coupled at their opposite ends to both support member 20 and base member 18 a secure and stable jack is provided. This arrangement is also simple and inexpensive to manufacture and operate. The realignment of jack 10 from its collapsed position to its upright position and from its upright position to its collapsed position may be simply accomplished by pivoting mechanisms 24, 26 to their appropriate positions. This eliminates fitting various parts together or aligning them as is necessary in conventional devices.

The use of a locking bar which is removably received in aligned openings in the base side rails and in the ramp side rails provides a secure locking arrangement to maintain jack 10 in its upright position. This locking arrangement is also simple to operate.

While various embodiments have been chosen to illustrate the invention, it will be understood by those skilled in this art that various changes and modifications can be made therein without departing from the scope of the invention as defined in the appended claims.

What is claimed is:

1. A collapsible jack movable between upright and collapsed positions, comprising:

a base member including a base plate and side rails coupled to and extending upwardly from said base plate, said base side rails having openings adjacent front ends thereof aligned along an axis perpendicular to said base side rails;

a support member including a support plate and side rails coupled to and depending from said support plate;

front and rear pivoting means for coupling said base member and said support member, each said pivoting means including upper and lower pivot rods extending perpendicular to said side rails and interconnected by rigid brace means fixedly coupled to said pivot rods at locations spaced inwardly from opposite ends thereof, said lower pivot rods having opposite ends journaled in said base side rails, said upper pivot rods having opposite ends journaled in said support side rails;

a ramp member including a ramp plate and side rails coupled to and depending from said ramp plate, said ramp side rails having upper ends journaled to said front upper pivot rod and lower ends having openings aligned along an axis perpendicular to said ramp side rails, said ramp openings being aligned with said base openings in said upright position; and a locking bar removably received in said ramp and base openings to lock the jack in said upright position.

2. A collapsible jack according to claim 1, wherein said side rails comprise tubes which are rectangular in cross section.

3. A collapsible jack according to claim 1, wherein upper surfaces of said support and ramp plates and a lower surface of said base plate have friction enhancing projections.

4. A collapsible jack according to claim 1, wherein said ramp rails have additional openings between opposite ends thereof aligned along an axis perpendicular to said ramp side rails and aligned with said base openings in said collapsed position to receive said locking bar and lock the jack in said collapsed position.

5. A collapsible jack according to claim 1, wherein said locking bar is tethered to said base member.

6. A collapsible jack according to claim 1, wherein said base side rails are spaced apart by a greater distance than said support side rails to permit said support side rails to nest between said base side rails in said collapsed position.

7. A collapsible jack according to claim 1, wherein said pivot rods are journaled in blind bores in said base and support side rails.

8. A collapsible jack according to claim 1, wherein said ramp side rails are spaced apart a distance less than said support side rails.

9. A collapsible jack according to claim 1, wherein said base plate extends forwardly beyond said base openings to form a traction pad in front of said ramp member in said upright position.

10. A collapsible jack according to claim 1, wherein each said brace means comprises two bars oriented at an acute angle and fixedly coupled at opposite ends thereof to respective pivot rods.

11. A collapsible jack movable between upright and collapsed positions, comprising:

a base member including a base plate and side rails coupled to and extending upwardly from said base plate, said base side rails having openings adjacent front ends thereof aligned along an axis perpendicular to said base side rails;

a support member;

front and rear pivoting means for coupling said base member and said support member, each said pivoting means including upper and lower portions, said lower portions journaled in said base member, said upper portions journaled in said support member;

a ramp member including a ramp plate and side rails coupled to and depending from said ramp plate, said ramp side rails having upper ends journaled to said support member, lower ends with lower openings aligned along an axis perpendicular to said ramp side rails and aligned with said base openings in said upright position, and additional openings between opposite ends thereof aligned along an axis perpendicular to said ramp side rails and aligned with said base openings in said collapsed position; and a locking bar removably received in said ramp and base openings to lock the jack in said upright position or said collapsed position.

* * * * *